US005354062A

United States Patent [19]

Lenger

[11] Patent Number: 5,354,062

[45] Date of Patent: Oct. 11, 1994

[54] COMBINATION PUTTING TARGET AND TABLE WITH STORAGE MEANS

[76] Inventor: Sidney A. Lenger, 1549 Squire Davis Rd., Kernsville, N.C. 27284

[21] Appl. No.: 81,394

[22] Filed: Jun. 22, 1993

[51] Int. Cl.[5] ..... A63B 69/36

[52] U.S. Cl. ..... 273/179 A; 312/237; 211/70.2

[58] Field of Search ..... 211/70.2, 62, 63, 64, 211/67, 68, 71; 312/237; 273/179 R, 179 A, 178 A

[56] References Cited

U.S. PATENT DOCUMENTS

| | | | |
|---|---|---|---|
| 405,335 | 6/1889 | Amerine | 211/64 |
| 584,678 | 6/1897 | Earle | 211/62 X |
| 3,134,934 | 5/1964 | Brandell | 273/179 A X |
| 3,154,314 | 10/1964 | McCune | 211/60 G X |
| 3,966,051 | 6/1976 | Hollister et al. | 211/70.2 X |
| 5,154,426 | 10/1992 | Black | 273/178 A X |

*Primary Examiner*—George J. Marlo
*Attorney, Agent, or Firm*—Marshall & Melhorn

[57] ABSTRACT

A cabinet table is provided which includes an arrangement for storing putters and golf balls, and a putting target with a solenoid return mechanism. The table provides a functional and attractive piece of furniture. In addition, the table provides all of the necessary items for a golfer to practice his or her putting strokes indoors. Apertures are aligned in the top and base of the table for storing putters. Grooves are provided for storing golf balls. The base is provided with an opening to approximate a standard cup used on golfing greens. A golfer may practice his or her putting stroke by removing a putter and golf ball from the storage area of the table and putting the golf ball into the opening. The solenoid return mechanism directs the ball back to the golfer.

4 Claims, 2 Drawing Sheets

COMBINATION PUTTING TARGET AND TABLE WITH STORAGE MEANS

BACKGROUND OF THE INVENTION

Tables have been designed to meet the interests of sportsmen throughout the ages. These tables have satisfied the sportsmen's various concerns.

Often times, tables have provided a means of storing the equipment used in particular sports and games and also have provided means for enabling the practice of the sport.

Golf is one of the sports which demands considerable skill in the aspects of driving, chipping and putting, for example. Over the years many devices and implements have been developed to assist the golf enthusiast in practicing the putting techniques in areas remote from the actual putting green of an existing golf course.

SUMMARY OF THE INVENTION

The present invention is directed to an article of furniture and more particularly to a table cabinet designed with the interests and concerns of the present day golf enthusiast.

It is an object of the present invention to produce in a single article of furniture for storing golfing accessories, such as putters and golf balls, for example, as well as manuals, teaching aids and general relevant magazines.

Another object of the invention is to produce an article of furniture which will provide a golfing enthusiast with an utilitarian means for practicing putting at places remote from the golf course.

Another object of the invention is to produce a furniture cabinet retaining various accountrements of the game of golf.

The above objects may be typically achieved by an article of furniture having a support surface engaging base, at least three cooperating wall panels extending vertically upwardly from the base and forming side walls of a compartment, the wall panels terminating in a continuous upper edge portion, a top panel having an upper surface and a lower surface, the lower surface adapted to be received by an secured to the upper edge portion of the wall panels, the base, the wall panels and the top panel cooperating to form a chamber having an opening, a door, hinge means for enabling the door to selectively close the opening of the chamber, and target means associated with the base for receiving a golf ball.

DESCRIPTION OF THE DRAWINGS

The above objects and attendant advantages of the invention will be clearly understood by one skilled in the art from reading the following detailed description of the preferred embodiment of the invention when considered in the light of the accompanying drawings in which.

DETAILED DESCRIPTION OF THE PREFERRED EMBODIMENTS OF THE INVENTION

Figure 1:
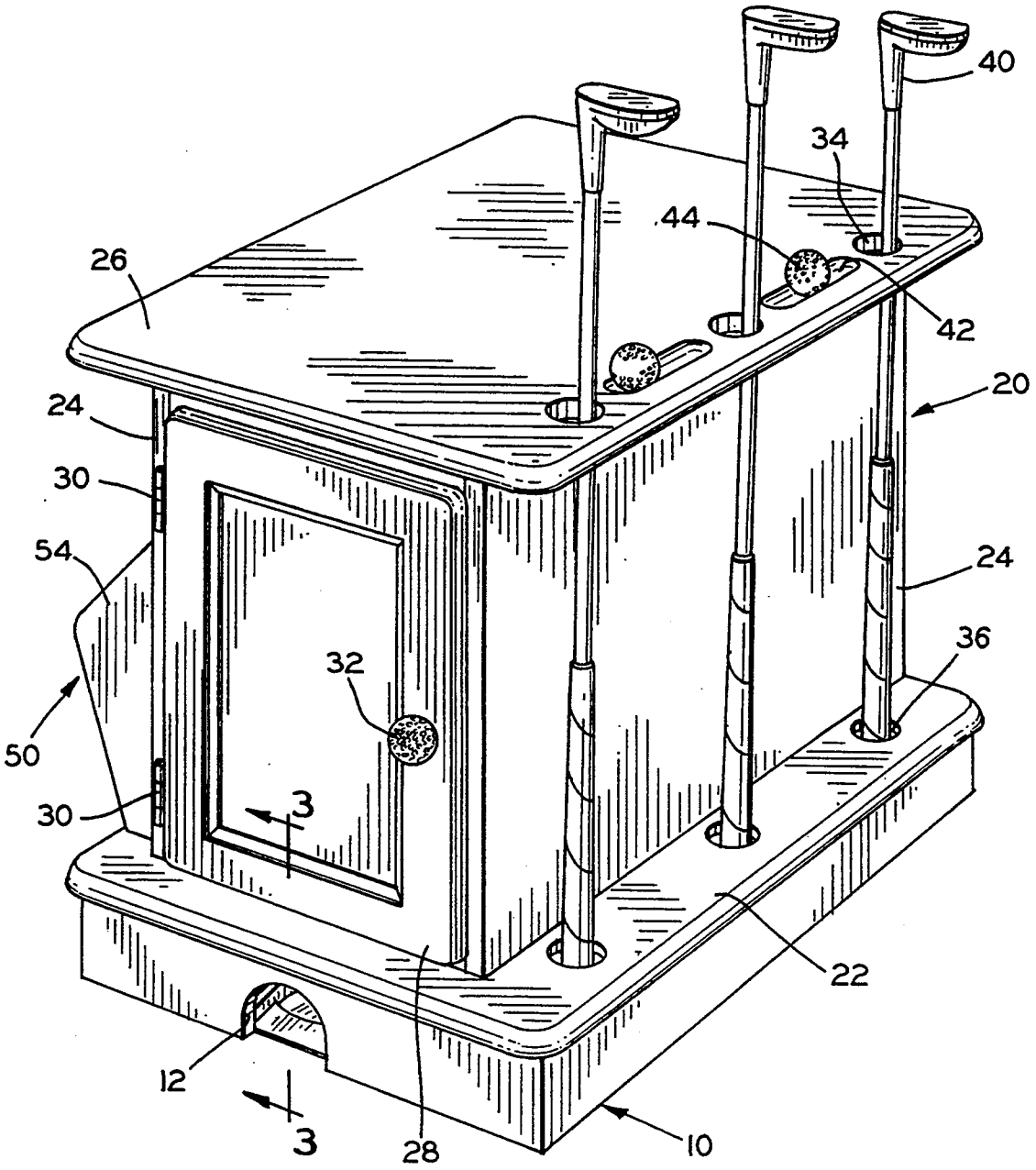
FIG. 1 is a perspective view of an article of furniture embodying the features of the present invention.
Figure 2:
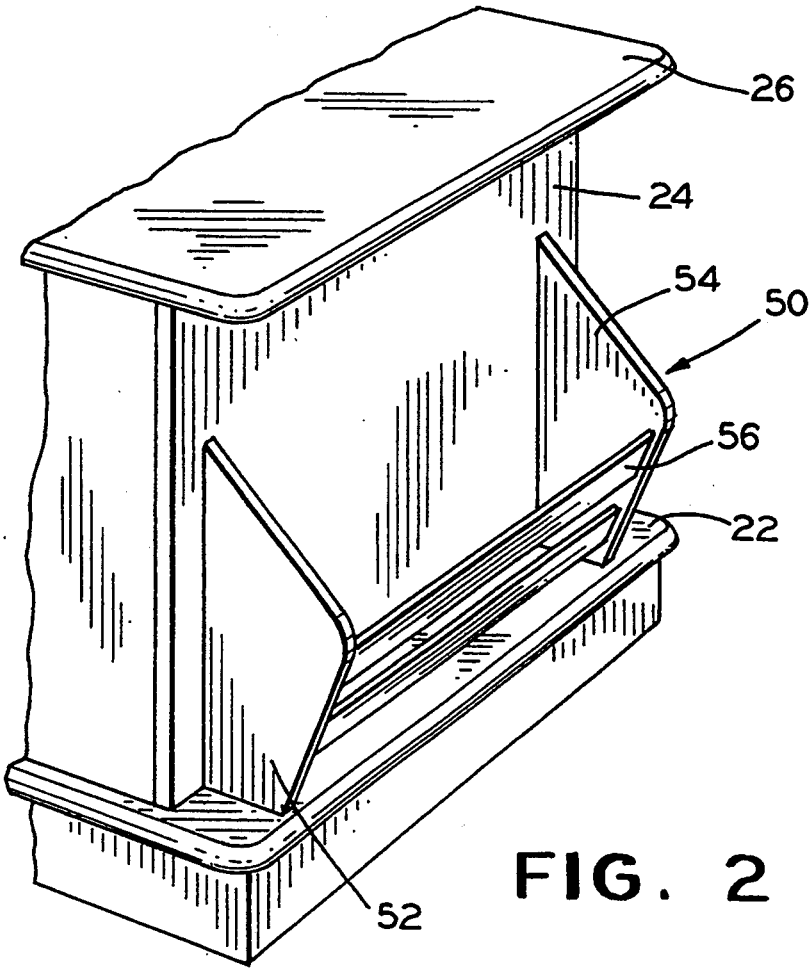
FIG. 2 is a fragmentary perspective view of the left hand side of the article of furniture illustrated in FIG. 1.

Referring to the drawings, there is illustrated an article of furniture, and more particularly, a cabinet embodying the features of the present invention.

The cabinet includes a base portion 10 formed of a plurality of rail members, preferably of wood, wherein the joint edges are mitered to produce a generally rectangular supporting member.

One of the rail members of the base 10 is provided with an opening 12. The opening 12 is aligned with a golf ball retriever mechanism 14 disposed internally of the base 12. The specific nature of the mechanism 14 will be explained in greater detail hereinafter.

A cabinet 20 is mounted on the base 10. The cabinet 20 is typically formed of wooden elements including a bottom panel 22, plurality of upstanding side panels 24, a top panel 26, and a door 28.

Hinge means 30 are employed to hingedly engage the door 28 to appropriate side panel 24. A handle 32 is affixed to the door 28 to facilitate grasping by a user to open the door 28 and thereby provide access to the interior of the cabinet formed by the cooperation of the bottom panel 22, the side panels 24, the top 26, and the door 28.

The side panel 24 forming the right hand side of the cabinet is positioned sufficiently inwardly of the right hand edges of the bottom panel 22 and the top panel 26 to enable a series of aligned apertures 24 and 26, respectively to be formed. The aligned apertures 34 and 36 are designed to receive a series of putters 40.

Elongate grooves 42 are formed in the upper surface of the top panel 26 to receive a plurality of golf balls 44.

On the opposite side of the cabinet from the aligned apertures 34 and 36, there is disposed a magazine rack assembly 50. The assembly 50 includes a pair of spaced apart outstanding vertically disposed wing members 52 and 54. Individual horizontally disposed spaced apart stringers 56 are employed to extend between the facing surfaces of the wing members 54 and 56. The ends of the stringers 56 are glued or otherwise suitably secured to the respective wrong members 52 and 54. It will be understood that a single panel may be utilized in lieu of the spaced stringers 56 to satisfactorily assist in the containing of magazines or the like in the assembly 50.

Figure 3:
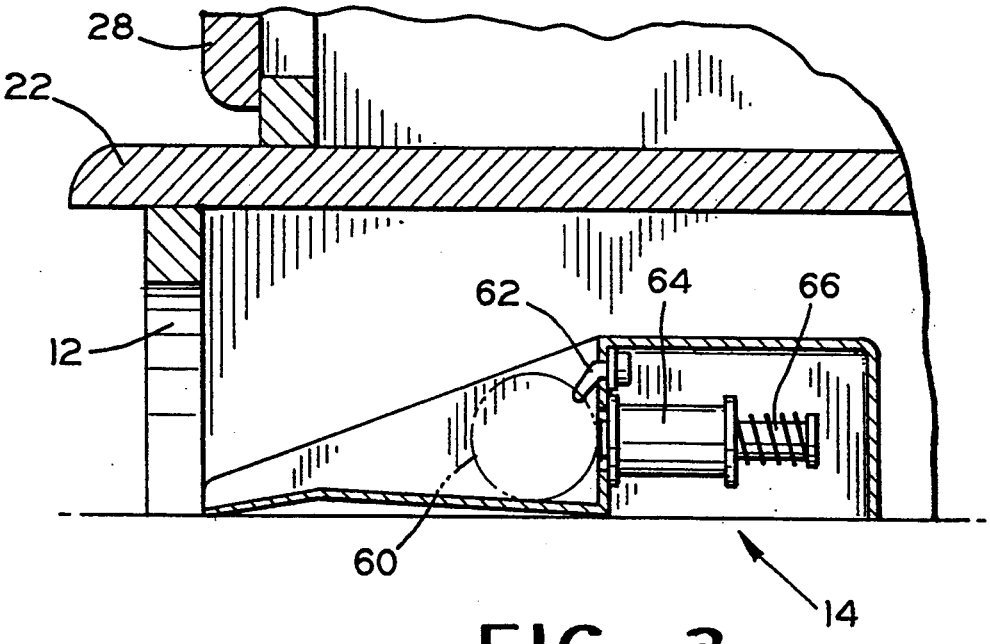
FIG. 3 is a fragmentary view taken generally along line 3—3 of FIG. 1.

The golf ball retriever mechanism 14 disposed within the interior of the base 10, and in alignment with the aperture 12 is illustrated in some detail in FIG. 3. The mechanism 40 is operative to return a golf ball 60 which is caused to travel through the opening 12 and contact a switch 62. Upon contact, the switch 62 completes an associated electrical circuit, not shown, to actuate a solenoid 64. The solenoid 64 will, in turn, cause an associated plunger 66 to thrust the actuating golf ball 60 in a reverse direction out of the base 10 through the aperture 12 from whence it came. Such retriever mechanism is commercially available and sold under the trademark THE PUTT MASTER manufactured and sold by VEF Manufacturing Company, Addison, Ill. 60101.

It will be appreciated that the aforedescribed invention provides a much appreciated and useful accoutrement to a golfer's accessories. The aesthetics of the table or cabinet of the invention may be varied or enhanced to satisfy an individual's personal performances. For example, in a preferred embodiment, the bottom panel 22 and the top panel 26 may be of a cherry wood grain. The rails which make up the base 10 may be painted green in color, while the exposed surfaces of the side panels 24 may be painted black. As a further decorative feature, the outer or exposed surface of the door 28 could contain indicia, such as crossed golf clubs or a country club insignia.

While the preferred embodiment of the invention has been illustrated and described, it must be understood that changes could be made without departing from the spirit of the invention as defined in the accompanying claims.

What is claimed is:

1. An article of manufacture adapted to be positioned on a floor for use as a cabinet table, and for use in practicing putting and storing putters and golf balls, said article of manufacture comprising:

a) a base for engaging a floor, said base including at least one generally verticle wall and a horizontal, planar panel at the upper end thereof;

b) a storage enclosure mounted on said horizontal, planar panel of said base, said enclosure including a top panel positioned parallel to said horizontal, planar panel of said base;

c) means for securing at least one putter to said article of manufacture;

d) means for storing at least one golf ball in said article of manufacture;

e) target means formed in said base, said target means including an aperture in the lower edge of said generally vertical wall for receiving a golf ball putted on said floor; and f) a ball return mechanism mounted in said base and aligned with said aperture for receiving an returning golf balls through said aperture.

2. The article of manufacture defined in claim 1 wherein said means for securing at least one putter includes at least one hole formed in said top panel for receiving a shaft of a putter.

3. The article of manufacture defined in claim 1 wherein said means for securing at least one putter includes at least one cooperating and aligned pair of holes formed in said top panel and in the horizontal, planar panel of said base for receiving a shaft of a putter.

4. The article of manufacture defined in claim 1 wherein said means for storing at least one golf ball includes at least one elongate groove formed in said top panel.

* * * * *